US005232281A

United States Patent [19]

Campbell

[11] Patent Number: 5,232,281

[45] Date of Patent: Aug. 3, 1993

[54] WATER COOLED DOOR FOR BLENDERS

[76] Inventor: Craig C. Campbell, P.O. Box 12698, Research Triangle Park, Durham, N.C. 27709

[21] Appl. No.: 800,127

[22] Filed: Nov. 29, 1991

Related U.S. Application Data

[63] Continuation of Ser. No. 531,345, May 31, 1990.

[51] Int. Cl.[5] ..... B01F 15/06; B01F 15/02

[52] U.S. Cl. ..... 366/144; 366/192

[58] Field of Search ..... 137/340; 165/168; 222/491, 564, 556; 366/144, 149, 192; 432/237

[56] References Cited

U.S. PATENT DOCUMENTS

| | | | |
|---|---|---|---|
| 604,967 | 5/1898 | Chivert | 222/556 |
| 4,706,854 | 11/1987 | Pole | 222/556 |
| 5,050,770 | 9/1991 | Smiley | 222/491 |

*Primary Examiner*—Harvey C. Hornsby

*Assistant Examiner*—Terrence R. Till

*Attorney, Agent, or Firm*—Breneman & Georges

[57] ABSTRACT

A water cooled blender door having an inside surface and an outside surface and a tapered edge having a taper away from the inside surface to the outside surface to provide a reduced area of contact for material flowing around the tapered edge which in combination with said water cooling allows condensate to form on the tapered edge to prevent materials from sticking to the blender door. A gap is also provided between the tapered edge and the blender door housing to prevent the build up of sticky matrix materials such as sticky wood particles. The cooling water typically at 40–50 degrees Fahrenheit causes a water condensate to form on the door surface and edge. The water condensate often results from the warm moisture laden air in the blender and prevents sticking of the resin coated particles to the surface and edges of the novel door.

19 Claims, 2 Drawing Sheets

WATER COOLED DOOR FOR BLENDERS

This application is a continuation of application Ser. No. 07/531,345, filed May 31, 1990, pending.

BACKGROUND OF THE INVENTION

1. Field of the Invention

This invention pertains to the construction of a water or fluid cooled door for a blender with a specific control of door size to provide a gap between the door and the blender housing together with a tapered edge construction. More particularly the design results in minimum pressure contact with adjacent support structure. The door design results in little or no continuous build-up of even sticky natured matrix materials, especially sticky wood particles. The cooling water, at a typical 40–50 degrees F., causes a water condensate to form on the door surface and edges. The water condensate often comes from the warm moisture laden air inside the blender. The layer of water condensate prevents sticking of the resin coated particles on the surface and edges of the door. The door remains operable over a sustained period of time without involuntary or unscheduled shut-down requirement. Product quality is improved. Blender operation time between scheduled maintenance down-time is greatly increased.

2. Description of the Prior Art

Prior art apparatus are well known for applying liquid or powdered resins to plastics, wood particles, or other matrix materials. Shaft and vessel walls are typically water cooled.

The exit door is typically not cooled but is coated with a plastic coating. The plastic material does not withstand the constant wear and abrasion where all the material passes out the exit of the blender across the surface of the exit door. The plastic wears through or is lifted up by the particles of the matrix, i.e., wood particles.

A major manufacturer typically constructs a riveted frame of metal "like a picture frame" around the plastic material of the door in order to keep the plastic in place.

The construction of the dry metal frame compounds the problem of matrix material build-up, i.e., wood particles, on the door surface and edges. The metal frame edges form another means, actually an easier means for the ready opportunity of build-up of matrix material onto the door.

The typical door construction and modifications in the prior art illustrates the complete misunderstanding of the real problem in product mixing.

Such prior art solutions as placing a metal frame around the door allows the door to remain intact for a longer period, but at the expense of (1) Faster material build-up, (2) Reduced quality of product, (3) poor door operation (or typically the door may become jammed partially open), (4) Immediate nonscheduled shut-down is necessary.

The current exit door construction in blenders (i.e. particle-board) results in numerous disadvantages:

1. The tight fitting edge of the door presses the sticky matrix clinging to the edge. This condition presents a constant problem in operating the door. There is insufficient door clearance. Usually, the door will become jammed in place.

2. A jammed door almost closed will cause overload amperage on the motor; the panel breakers will overload and the blender will be shut down. The entire production line will have to stop while the door is being cleaned.

3. A jammed door partially open will remain in one position. This is often the case.

4. An operator will wire a door to its full open position.

5. A door will be removed completely.

6. Constant wear on the dry metal surface of the door and on the plastic cover added by some manufacturers to the door to prevent sticking will cause the plastic to lift off or wear away completely. The exposed dry metal leads to material buildup.

7. The resin and wood chip mixture can become very hard. These hard pieces can fall away, often in relatively large sizes and can cause harm in forming teeth in subsequent processing equipment or can cause difficulty in the board product itself.

8. Hard resin deposits in the board cause resin spots on board edges or on the surface.

9. Hard resin deposits often fall out of the board and cause cavities in the board edges or surface. The typical present exit door construction has been in effect for a number of years without an attempt to solve the problem of material buildup.

Some particleboard plants are now using a pressure control on the door, pressure related to the amperage load on the motor. A specific amperage load is maintained to keep the blender "working", i.e., greater energy level of mixing.

The increased pressure of the door closing mechanism again adds to the problem because now the sticky matrix is pressed in place "balled up", as in the making of a "snow ball" effect. The build-up continues until the door is inoperable. Or the material which is now built up on the "picture frame" will fall off into the product mixture. As a result the hard now silhouetted "pieces of matching picture frame" are now loose in the product mixture to cause harm in machine teeth in subsequent operations or forming and in the product itself.

SUMMARY OF THE INVENTION

It is the principal objective of this invention to aid in providing a homogeneous mixture of wood particles with resin coating using a production blender without non-scheduled shut-down. The objective of the invention is to provide a door without problems, because it has been observed the door of the prior art has been a constant problem and the usual cause of an unscheduled shut-down.

The door edge design of the invention is tapered and the gap around the door is generous (0.500 in. to 0.750 in.) to minimize a condition for binding.

The door is fully water cooled, made of smooth metal construction to prevent conditions that initiate build-up. A stainless steel face plate presents a smooth working face. The cooled door results in water condensate on the surface which prevents stick build-up. Since there is minimum contact at the tapered edge, even at the nearly closed condition, the door operates without problems in its true function—which is like a constantly moving valve—never fully open and never fully closed.

The use of the water cooled door as described in this preferred embodiment results in the following major advantages:

1. Water cooling results in water condensation formation as in a "dew point" from the ambient, warmer atmosphere. Sticky materials are repelled by the wet surface and adherence of the matrix is minimized or totally eliminated.

2. Minimum pressure of the tapered edge results in little or no edge build-up of sticky materials. Maximum clearance at the edge, in keeping with practical operation, further reduces the possibility of pressure and squeezing of the sticky matrix.

3. Smooth door construction eliminates any projections to initiate build-up of material.

4. The door operates with constant movement—opening with the force of material being pushed out of the blender immediately tending to close because of the counter force by the extended weight on the fulcrum.

5. The door operates as a valve—never fully open, and —never fully closed.

6. Mixing quality aided by the door is maximized.

7. The door never presents a reason for blender shutdown.

The advantages of the invention are achieved by the utilization of:

1. An exit door that is water cooled using coils or a labyrinth system to conduct flow of refrigerated water.

2. The edges of the door, on all four sides, are tapered at an apex of 30 degrees to 90 degrees, preferably less than 90 degrees.

3. An opening of 0.125 in or larger, perferably 0.750 in, is maintained around the edge of the door.

4. Door construction is made smooth, preferably welded with stainless steel upper contacting surface or of other selected metal construction. There is an absence of any projections of any kind.

DETAILED DESCRIPTION OF THE PREFERRED EMBODIMENT

It has been observed that the exit door in a typical particleboard blender is the least understood part of the blender.

The blender exit door is relatively small, compared to the total area of the blender surface. The rectangular exit door fits into a provided opening and is secured to a moving arm or fulcrum precisely in the same manner of a "seat on a seesaw". As the opposite and weighted end of the fulcrum moves down, the door, "the seesaw", moves up. Conversely, as the opposite and weighted end of the fulcrum moves up, the door, "the seesaw" moves down—in the open position. The fulcrum and the door are fixed; there are no moving parts.

The exit door, approximately 10 in. by 14 in. on a cylindrical blender 24 in. diameter and 12 feet long—when operating properly—is constantly moving in an arc, i.e. attached to a fulcrum, and is never fully closed nor never fully open. The door actually operates like a valve for the particleboard blender.

When the door stops moving, it is no longer reacting to the flow of material. In most cases, the exit doors in particleboard plants have ceased to move: the door has become jammed.

Figure 1:
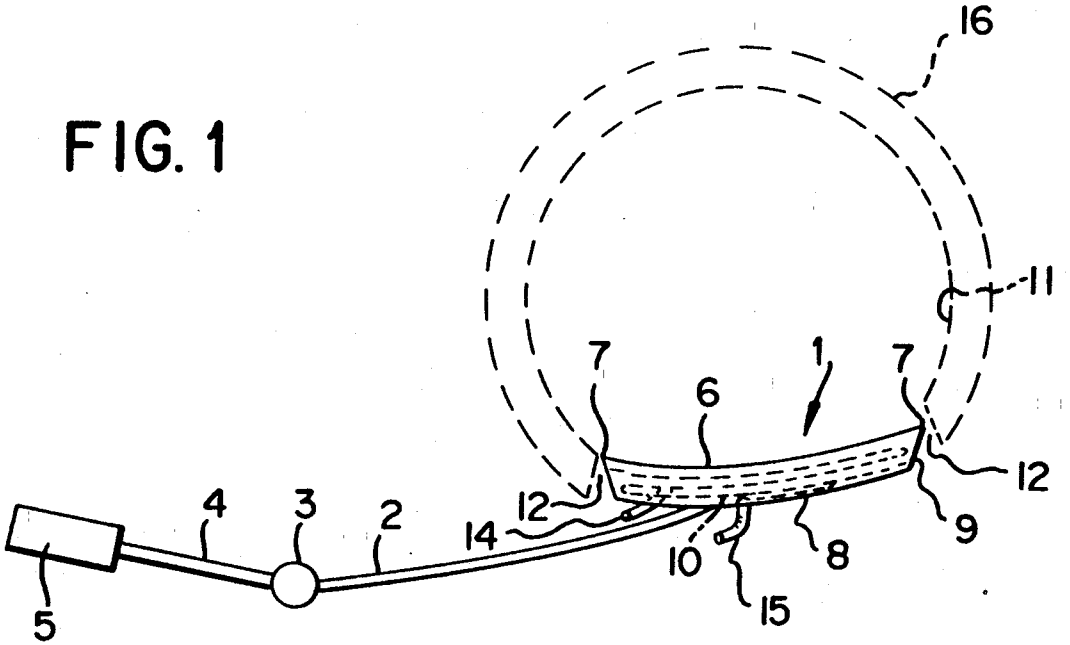
FIG. 1 is a side elevational view of a blending machine door constructed in accordance with the invention including a tapered edge with internal water cooling and a weighted arm forming a door closure means including a blender housing illustrated in phantom.

Referring now to FIG. 1 a side view of the door 1 is illustrated having a metal arm 2 which is attached between the sleeve 3 and the water cooled door 1 and a counterbalance weight 5 which is attached to an extended metal arm 4 that is also attached to the sleeve 3. There are no moving parts in this construction except as in the arc movement of the fulcrum which imparts a seesaw valve type action to the operation of the door. Usually the parts of the door are welded together. The door and parts 2,3,4 and 5 do not move in relation to one another.

Figure 2:
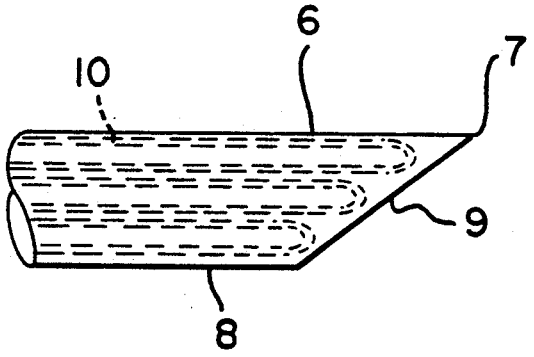
FIG. 2 is an enlarged view taken from Section A of FIG. 1 illustrating the tapered edge of the blending machine door.

FIG. 2 is an enlargement of Section A of FIG. 1. The upper surface 6 of the door 1 is the largest dimension or has the greatest surface area of the door and includes a tapered edge 9 tapering at an angle of about 30 to 90 degrees and preferably less than 90 degrees tapering downwardly and inwardly toward the lower surface 8, the angle of inclination being with respect to a horizontal axis. The lower surface 8 and upper surface 6 are preferably of a concave configuration and are complimentary to each other as shown in FIGS. 1 and 2 and in such complementary concave configurations are designed so that lower surface 8 has less surface area and does not extend as far laterally as the top surface 6. The door is water cooled by cooling coils 10 having an inlet 14 and an outlet 15 on the door 1 (FIG. 1) to provide a labyrinth flow or a fluid routing means for conveying a cooled fluid at a temperature lower than ambient air temperature surrounding the exit door to provide for the flow of fluids such as refrigerated water.

Figure 3:
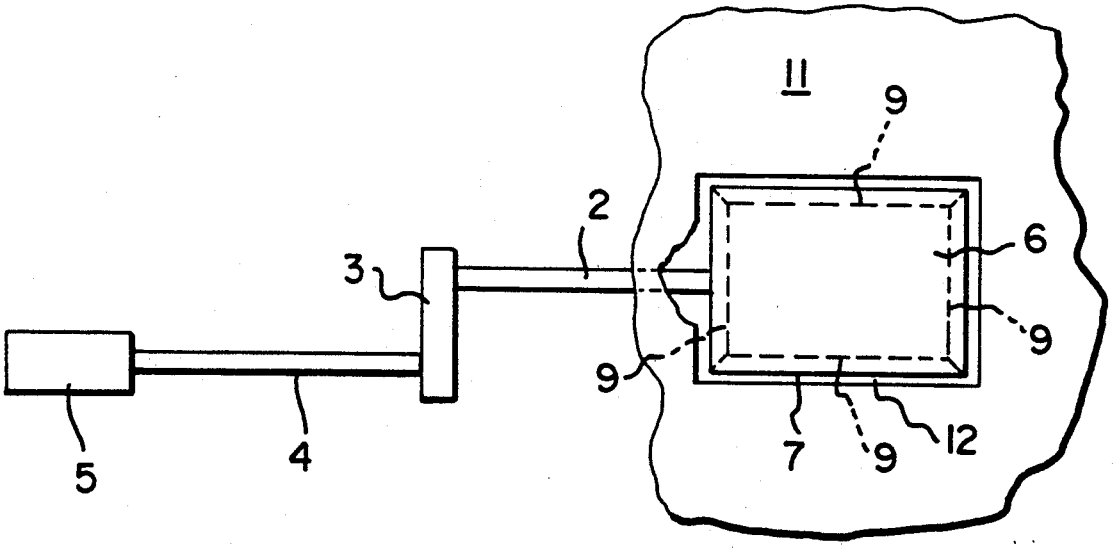
FIG. 3 is a top plan view partly in phantom of the blending machine door as viewed form inside the blending machine housing illustrating the gap between the blender door and blending machine housing and the downwardly and inwardly tapered edge.

Referring now to FIGS. 1, 2 and 3 the top or inside view of the door is illustrated showing the door 1 with the door metal arm 2 attached to the second surface 8 and the shaft sleeve 3 of the water cooled door which forms part of the door closure means for biasing the exit door toward a closed position.

In FIG. 3 a portion of the inside 11 of the blending machine housing 16 (FIG. 1) is also illustrated showing the gap 12 provided between the edge 7 of the door and the blending machine. The gap or opening is 0.125 or larger and is preferably 0.750 inch all around the perimeter of the door. The edges 7 of the door, on all four sides are tapered to an apex of 30 degrees to 90 degrees and is preferably less than 90 degrees. The gap 12 is an opening of 0.125 inch or larger preferably 0.750 inch and is maintained around the edge of the door. The preferred embodiment of the invention the door is of a smooth construction preferably with a stainless steel upper contacting surface or other selected metal construction. There is an absence of any projections of any kind on the upper surface 6.

What is claimed is:

1. A valve type door for blending materials containing moisture laden air in a blending machine comprising:

(a) a first surface designed to contact material in a blending machine;

(b) a second surface of substantially the same geometrical configuration as said first surface disposed adjacent to said first surface and having a surface area less than the surface area of said first surface;

(c) a tapered edge connecting said first surface with said second surface by tapering downwardly and inwardly from said first surface to said second surface; said tapered edge forming a minimum contact angle at the intersection of said first surface and said tapered edge to provide a reduced area of contact for material flowing around said tapered edge;

(d) a hollow cooling duct disposed between said first surface and said second surface for conveying a cooling fluid for cooling said first surface and said tapered edge to a temperature lower than warm moisture laden air inside said blending machine in contact with said first surface of the blending machine door to provide condensation on said minimum contact angle of said tapered edge to prevent materials from sticking to said tapered edge upon exiting said blending machine; and (e) a gap of from about 0.125 to about 0.750 inch between said tapered edge and the blending machine housing at the closure position of said blending machine door so that in operation said blending machine door operates as a constantly moving valve that is never fully closed or ever fully opened.

2. The valve type door of claim 1 wherein said first surface is of a generally concave configuration.

3. The valve type door of claim 2 wherein said first surface is composed of stainless steel.

4. The valve type door of claim 1 wherein said minimum contact angle is an angle of from about 30 to 89 degrees.

5. The valve type door of claim 1 wherein said gap is from about 0.5 inch to about 0.75 inch.

6. The valve type door of claim 1 further comprising a door closure means disposed on said second surface.

7. A blending machine door for blending materials in a blending machine containing moisture laden air comprising:

(a) a concave first surface for forming the front side of the blending machine door;

(b) a second surface disposed behind said concave first surface forming the back side of said blending machine door;

(c) a tapered edge joining said concave first surface to said second surface and tapering downwardly and inwardly form said first concave surface to said second surface to form a minimum contact angle at the intersection of said tapered edge and said concave first surface and having a taper angle of from about 30 to 89 degrees between said concave first surface and said tapered edge;

(d) a hollow cooling duct disposed between said concave first surface and said second surface for cooling said first surface and said tapered edge to provide condensation of moisture laden air on said minimum contact angle to prevent blended materials exiting a blending machine from sticking to said tapered edge;

(e) fluid inlet means disposed on said second surface and connected to said hollow cooling duct;

(f) fluid outlet means disposed on said second surface and connected to said hollow cooling duct; and (g) a door closure means including biasing means attached to said second surface for biasing said blending machine door toward a closed position so that in operation said blending machine door operates as a constantly moving valve that is never fully closed or ever fully opened.

8. The blending machine door of claim 7 wherein said concave first surface is composed of stainless steel.

9. The blending machine door of claim 8 further comprising a gap of from about 0.125 to about 0.750 inch between said tapered edge of said door and the blender machine housing.

10. The blending machine door of claim 9 wherein said gap is about 0.5 inch to about 0.75 inch.

11. A water cooled exit door for controlling the flow of material containing warm moisture laden air in a particleboard blender comprising:

(a) a first surface for contacting material in a blending machine and a gap disposed between the perimeter of said first surface and the blender housing;

(b) a second surface;

(c) a tapered edge joining said first surface and said second surface and tapering downwardly and inwardly from said first surface to said second surface, said tapered edge forming a minimum contact angle at the intersection of said first surface and said tapered edge to prevent compaction of material;

(d) fluid routing means for conveying a cooled fluid at a temperature lower than warm moisture laden air inside said blending machine in contact with said first surface of the exit door, said cooled fluid producing a condensation surface on said exit door to prevent material from sticking to said first surface of said exit door; and (e) an exit door closure means for biasing said exit door toward a closed position so that in operation said exit door of said blending machine operates as a constantly moving valve that is never fully opened or ever fully closed.

12. The door of claim 11 wherein said first surface is of a smooth concave contour.

13. The door of claim 12 wherein said first surface is composed of stainless steel.

14. The door of claim 11 wherein said gap between said first surface and said blender housing is from about 0.125 to about 0.750 inch.

15. The door of claim 14 wherein said gap is from about from about 0.6 inch to about 0.75 inch.

16. The door of claim 11 further comprising a fluid inlet means connected to said fluid routing means.

17. The door of claim 16 further comprising a fluid outlet means connected to said fluid routing means.

18. The door of claim 11 wherein said door closure means is disposed on said second surface.

19. The door of claim 18 wherein said door closure means includes a weighted arm attached at one end to said second surface with a weight at said other end and a fulcrum means disposed intermediate said ends.

* * * * *